United States Patent [19]

Nederman

[11] Patent Number: 4,530,474

[45] Date of Patent: Jul. 23, 1985

[54] BRAKING DEVICE FOR MOTOR-DRIVEN REELING DEVICES

[76] Inventor: Bill P. P. Nederman, F.M. Franzén Gata 2, S-252 28 Helsingborg, Sweden

[21] Appl. No.: 563,808

[22] Filed: Dec. 21, 1983

[30] Foreign Application Priority Data

Dec. 21, 1982 [SE] Sweden ..... 8207284

[51] Int. Cl.[3] ..... B65H 17/46

[52] U.S. Cl. ..... 242/84.52 R; 254/378; 188/185

[58] Field of Search ..... 242/84.52 R, 84.52 A, 242/86, 84.5, 99, 84.51 R, 86.7, 107.3; 254/378; 188/185, 184, 181 A, 180

[56] References Cited

U.S. PATENT DOCUMENTS

| | | | |
|---|---|---|---|
| 2,610,810 | 9/1952 | Pelouch | 242/86 |
| 4,461,460 | 7/1984 | Telford | 254/378 X |

FOREIGN PATENT DOCUMENTS

| | | | |
|---|---|---|---|
| 509505 | 10/1930 | Fed. Rep. of Germany | 242/84.52 A |
| 667680 | 10/1929 | France | 242/84.52 A |
| 914658 | 10/1946 | France | 254/378 |
| 622525 | 5/1949 | United Kingdom | 242/84.52 A |

*Primary Examiner*—Stephen Marcus
*Assistant Examiner*—Leo J. Peters
*Attorney, Agent, or Firm*—Schwartz, Jeffery, Schwaab, Mack, Blumenthal & Evans

[57] ABSTRACT

In a braking device for motor-driven reeling devices, a motor-driven reeling drum (5) cooperates with a brake (10) for braking thereof. In order to provide a simple braking device which is suitable primarily for reeling devices of a more simple type, the driving motor (7, 11) of the reeling drum (5) is movably mounted such that it is movable relative to the brake (10) with which it cooperates via a movement transferring system (12, 20) for controlling the braking effect of the brake.

11 Claims, 3 Drawing Figures

BRAKING DEVICE FOR MOTOR-DRIVEN REELING DEVICES

BACKGROUND OF THE INVENTION

The present invention relates to a braking device for motor-driven reeling devices, wherein a motor-driven reeling drum cooperates with a drum brake for braking thereof.

In order to brake reeling devices in a desired manner, one-way gears or electromechanical brake arrangements are normally required. Such arrangements may be suitable in connection with large reeling plants, but for reasons of cost, placement and reliability in operation, they are less suitable for more simple reeling devices, e.g. exhaust-hose reels. Such reeling devices are simple, they lack space for complex brake arrangements and they are often carelessly handled.

The object of the present invention is to eliminate the above drawbacks and provide a simple braking device which is especially suitable for reeling devices of simple type, e.g. exhaust-hose reels. This is achieved by designing the braking device as defined in the following claim 1.

BRIEF DESCRIPTION OF THE DRAWINGS

The invention will now be described in more detail with reference to the accompanying drawings, in which.

DETAILED DESCRIPTION OF A PREFERRED EMBODIMENT

Figure 1:
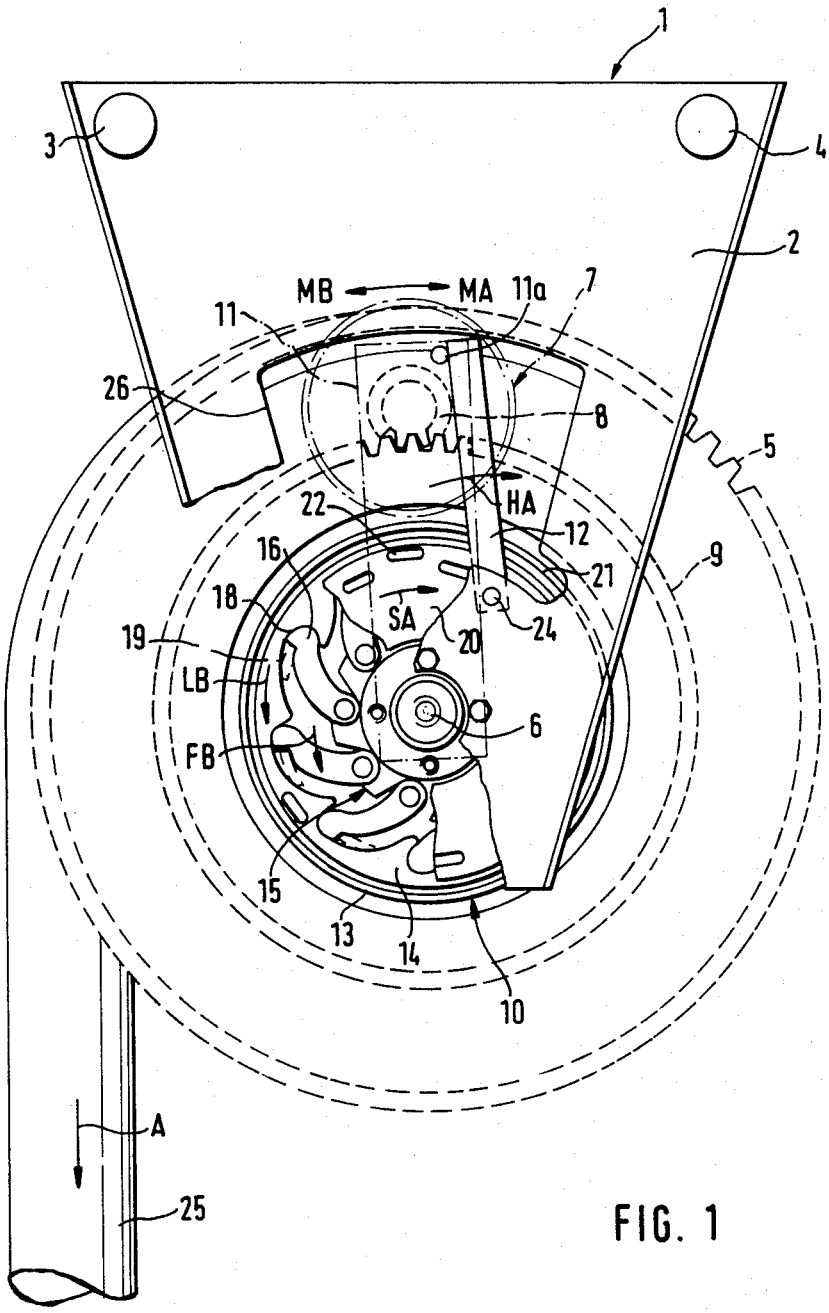
FIG. 1 is a side view of an exhaust-hose reel having a braking device according to the invention.

The reeling device illustrated in the drawings is intended for winding-up exhaust hoses and comprises a frame 1 with two end plates 2 connected to each other via rods 3, 4. A reeling drum 5 is provided between the end plates 2 and journalled on an axis 6 which in turn is journalled in the end plates. The reeling drum 5 is driven by an electric motor 7, which via a driving gear 8 cooperates with a gear ring 9 provided on the reeling drum 5.

The motor 7 is intended for controlling a (in the unwinding direction preferably irreversible) drum brake, so that during unwinding, the braking force is adapted such that an unwinding speed corresponding to the motor speed is obtained. For this purpose the motor 7 is mounted on or attached to a swinging arm 11 which is pivotally journalled on the axis 6 for the reeling drum 5 such that the motor 7 may move backwards and forwards along a portion of the gear ring 9 (arrow MA-MB). This movement is used for guiding the drum brake 10 via a head 11*a* on the motor 7 and a lever 12 affected by said head 11*a*.

In the present embodiment, the drum brake 10 has a large braking effect in the unwinding direction and a small braking effect in the wind-up direction. In order to accomplish this, the drum brake 10 comprises a brake drum 13 mounted on the reeling drum 5 and a brake ring 14 inside the brake drum, said brake ring being made of elastic material and surrounding a lock-finger means 15 with a number (here, nine) lock fingers 16. The lock-finger means 15 is screwed onto one of the end plates 2 of the frame 1. The lock fingers 16 are pivotally journalled in said lock-finger means 15 and may swing outwardly in a direction from the axis 6 towards the brake ring 14, which is provided with a recess 18 for each lock finger 16. Each lock finger 16 cooperates with guide pins 19 on a guide plate 20 having a shoulder 21 for cooperation with the lever 12. The guide plate 20 also has a number (here, three) of catching pins 22, which engage somewhat longer recesses 23 in the brake ring 14. These catching pins 22 limit the movement of the brake ring 14 relative to the lock fingers 16, such that the drum brake 10 is given a limited brake stroke, whereby unintentional braking in the wind-up direction is prevented.

The lever 12 is affected by the head 11*a* at a distance X from the shoulder 21 and is pivotally journalled on the frame 1 through a bearing 24 on the opposite side of the shoulder 21 and at a distance Y therefrom. The ratio of the distances X and Y is about 10:1, which means that the force of the movement of the motor 7 is geared up substantially for obtaining sufficient braking force.

Figure 2:
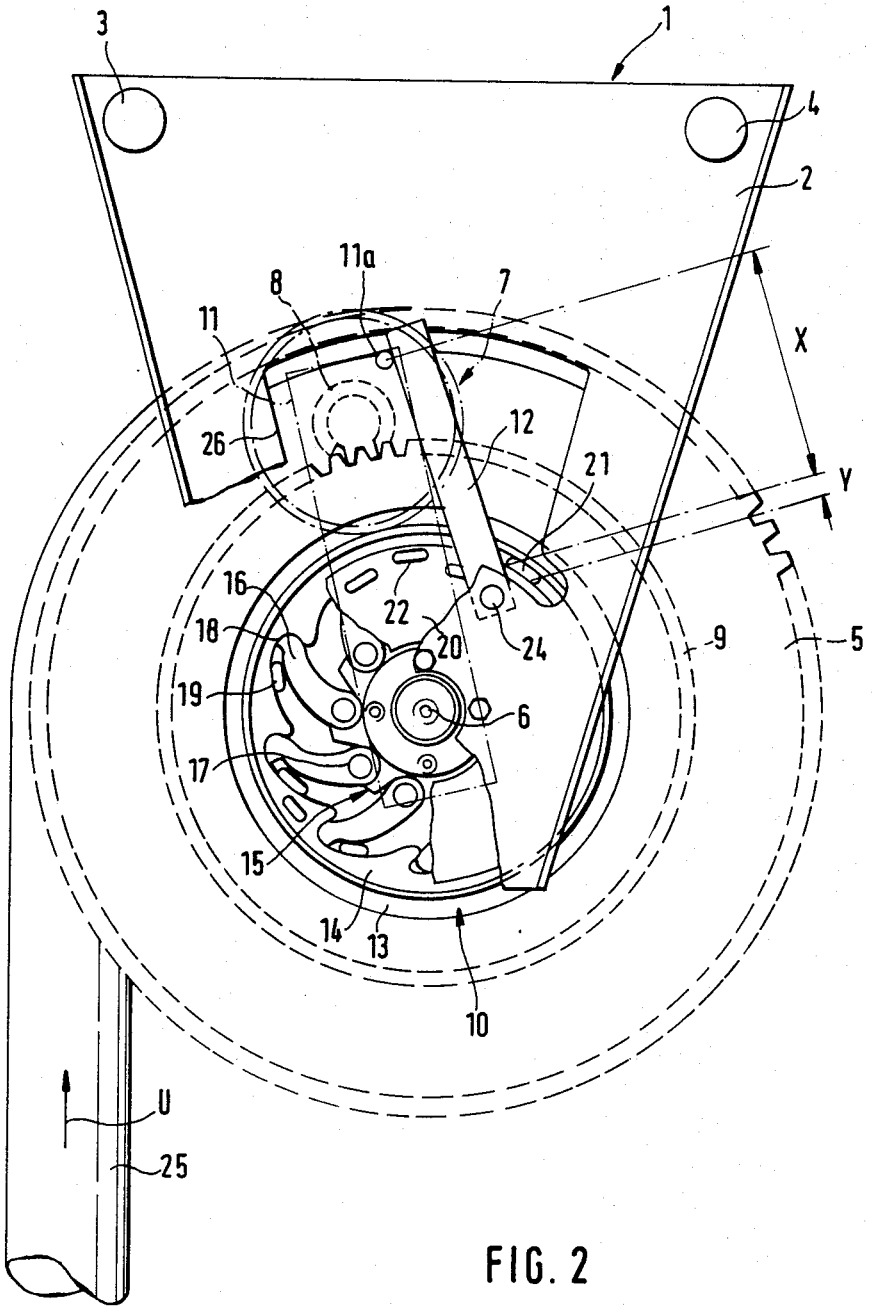
FIG. 2 is a side view of the same exhaust-hose reel but in another operating condition than in FIG. 1.
Figure 3:
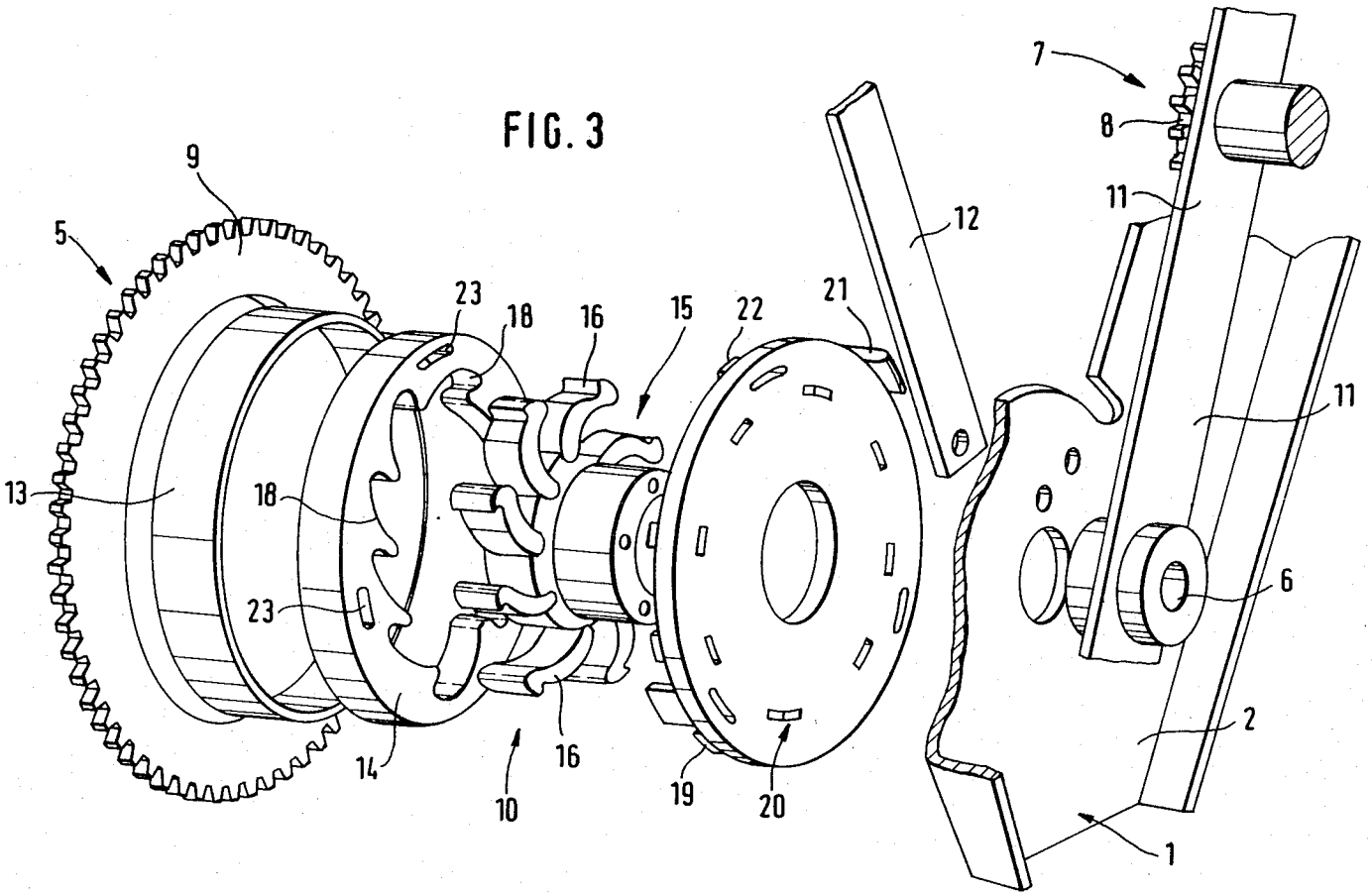
FIG. 3 is an exploded view of details forming part of the braking device according to the invention.

During unwinding of the hose 25 from the reeling drum 5, the motor 7 rotates the drum 5 in the direction of arrow A. Thereby, the motor 7 will move in direction MA from a rest position, in which the swinging arm 11 thereof engages a frame portion 26, and the head 11*a* thereof will thereby pivot the lever 12 (arrow HA), which in turn rotates the guide plate 20 (arrow SA), whereby the guide pins 19 deflect the lock fingers 16 such that their locking pressure against the brake ring 14 ceases. Hereby, the brake ring 14 does not exert any braking force against the brake drum, which is schematically shown in FIG. 1 by the brake ring 14 being positioned at somewhat distance from the brake drum 13. In reality, there is always a certain frictional engagement between the brake ring 14 and the brake drum 13. If the unwinding speed is increased (e.g. because of the weight of the hose 25), the motor 7 will move in the direction of arrow MB towards the frame portion 26. Hereby, the lever 12 and guide plate 20 are released, whereby the brake drum 13 affects the brake ring 14 through its frictional cooperation therewith (arrow LB). The brake ring 14 in turn affects the lock fingers 16 (arrow FB), such that said fingers are forced outwards against the brake ring 14, which is hereby pressed outwards towards the brake drum 13 and applies thereon a braking effect until the unwinding speed is reduced (see FIG. 2). When this has happened, the motor 7 will again move in the opposite direction (direction MA), with the result that the braking effect is once again reduced and the system motor/brake will again set itself in a balance position, at which an unwinding speed corresponding to the motor speed is obtained. Hereby, the braking effect will change in relation to the unwinding speed, which means that the drum brake 10 will function automatically or in a "load sensing" manner.

When the motor 7 stops after unwinding, it will assume its rest position adjacent the frame portion 26, which means that the drum brake 10 will be unaffected by the movement transferring system of the motor and have full braking effect.

When winding-up the hose 25 (arrow U, FIG. 2), the motor 7 engages the frame portion 26 and does not affect the drum brake 10, which has a small braking effect in the wind-up direction. When the motor 7 stops, the brake will retain the load by irreversibility (large braking effect) in the unwinding direction.

The braking device according to the invention may vary within the scope of the following claims. Thus, the brake drum 13, brake ring 14, lock-finger means 15 and lock fingers 16 may be designed in another way and include another number of members than shown in the drawings. The brake ring 14 may comprise an elastic ring with resilient function. Outside the elastic ring, a further frictional ring may be provided or frictional material may be applied on the other side of said elastic ring.

The movement of the motor 7 relative to the drum brake 10 may be transferred thereto via another movement transferring system than the lever 12 and guide plate 20.

The braking device may be of another type than the internal drum brake shown here, e.g. an external strap brake or disc brake.

The braking may also be obtained in another way than by irreversibility, e.g. by setting up frictional elements with springs. The motor may in the same way as by unwinding, affect the brake during wind-up, while the brake in itself has no small braking effect in the wind-up direction.

The braking device according to the invention is usable with other types of reeling devices than exhaust-hose reels, e.g. in reeling devices for other types of hoses, cables, lines, wires, etc.

I claim:

1. A braking device for a motor driven reeling device comprising:

a reeling drum;

controllably applicable brake means for braking rotational movement of said reeling drum;

a motor drivingly engaging a drive ring on said reeling drum and pivotably mounted eccentricly of the axis of said reeling drum for movement along an arcuate path the center of which lies on the axis of said reeling drum; and movement transferring means operatively interposed between said motor and said brake means for controllably applying said brake means in response to movement of said motor along said arcuate path.

2. A braking device according to claim 1, wherein said brake means comprises a brake drum connected to said reeling drum, a brake ring frictionally engaging said brake drum, and a plurality of pivotable locking fingers engaging said brake ring, said locking fingers pivoting toward said brake ring to press said brake ring against said brake drum when the brake is applied.

3. A braking device according to claim 2, wherein said movement transferring means comprises means for limiting the pivoting movement of said locking fingers toward said brake ring in response to the movement of said motor along said arcuate path.

4. A braking device according to claim 3, wherein said limiting means comprises a guide plate provided with guide pins engaging said locking fingers, said guide plate being pivotable about the axis of said reeling drum in response to the movement of said motor along said arcuate path.

5. A braking device according to claim 4, wherein said guide plate is provided with at least one catch pin engaging said brake ring for limiting the movement of said brake ring with respect to said locking fingers.

6. A braking device according to claim 1, wherein said movement transferring means comprises a lever means having a long lever arm engaging said motor and a short lever arm engaging said brake means, whereby the force of movement of said motor is increased as it is applied to said brake means.

7. A braking device according to claim 6, wherein said short lever arm engages a shoulder on a pivotable guide plate which controls the application of said brake means.

8. A braking device according to claim 1, wherein said motor is mounted on a swinging arm pivotably journalled on the axis of said reeling drum, and said drive ring of said reeling drum comprises a ring gear engaged by a drive gear driven by said motor.

9. A braking device according to claim 8, wherein when said motor is stopped and during wind-up of an article onto said reeling drum, said motor is pivoted into engagement with a frame member which limits further pivoting movement of the motor.

10. A braking device according to claim 1, wherein said brake means are applied when said motor is stopped.

11. A braking device according to claim 1, wherein said motor is a reversible motor which is driven in one direction during wind-up of an article onto said reeling drum and in the opposite direction during unwinding of an article from said reeling drum.

* * * * *